United States Patent [19]

Bongers et al.

[11] 4,298,820

[45] Nov. 3, 1981

[54] LUMINESCENT SCREEN

[75] Inventors: Piet F. Bongers; Maurits W. van Tol; John M. Robertson, all of Eindhoven, Netherlands

[73] Assignee: U.S. Philips Corporation, New York, N.Y.

[21] Appl. No.: 49,993

[22] Filed: Jun. 18, 1979

[30] Foreign Application Priority Data

Jun. 26, 1978 [NL] Netherlands ..... 7806828

[51] Int. Cl.[3] ..... H01J 29/10

[52] U.S. Cl. ..... 313/463

[58] Field of Search ..... 313/463, 461

[56] References Cited

U.S. PATENT DOCUMENTS 3,247,389 4/1966 Kazan ..... 313/463 X

*Primary Examiner*—Palmer C. Demeo

*Assistant Examiner*—Darwin R. Hostetter

*Attorney, Agent, or Firm*—Norman N. Spain

[57] ABSTRACT

A luminescent screen consisting of one self-supporting monocrystalline body and having a luminescent surface layer with V-shaped grooves. Such screens may be exposed to radiation having a larger energy than was usual so far with phosphor screens and have a very large luminous efficiency. In addition the resolving power is very large since there are no particles with limiting dimensions. Such screens may be used for displaying very bright pictures suitable for projection on a projection screen.

8 Claims, 9 Drawing Figures

LUMINESCENT SCREEN

The invention relates to a luminescent screen comprising a substrate having a luminescent layer of a monocrystalline structure and comprising at least one activator.

The invention also relates to a cathode ray tube having such a luminescent screen.

Such a luminescent screen is disclosed in German Patent Specification No. 810,108. Such luminescent screens are used in cathode ray tubes, for example, television display tubes, in electron microscopes and electron spectroscopes and in forming pictures in X-ray devices, for example X-ray image intensifiers.

German Patent Specification No. 810,108 discloses that a monocrystalline luminescent screen can be obtained by growing an activated monocrystalline layer on an auxiliary plate, for example, by vapour deposition or sublimation. The auxiliary plate consists preferably of a crystal having the same or approximately the same lattice dimensions and itself is a single crystal. If desired the auxiliary plate is dissolved after having adhered the activated monocrystalline layer to another support, for example, a glass plate. A disadvantage of such luminescent screens is that with high excitation energy the thermal loadability for a number of applications is much too small and that diffuse reflections of the light generated in the activated layer occur at the interfaces of the support or the auxiliary plate and the activated layer.

It is also known to use powdered phosphors provided on a support as a luminescent screen. These screens also have only a low thermal loadability since the thermal energy is dissipated from the phosphor grains to an insufficient extent. Moreover, the resolving power of the display screen is limited by the dimensions of the grains. As a result of the large number of grains the specific area of the screen is large, which has a detrimental influence on the vacuum in a cathode ray tube.

Another construction in which these diffuse reflections occur is disclosed in Netherlands Patent Specification No. 61451 in which the screen is constructed from rod-shaped luminescent crystals which are provided on a support and which mutually are all substantially parallel and extend with their longitudinal direction perpendicularly or approximately perpendicularly to the surface of the support so that the direction of the exciting rays is substantially parallel to the longitudinal direction of the crystals. A disadvantage of this construction is again that the thermal loadability of the luminescent screen is too small for a number of applications. In addition, the resolving power is restricted by the dimensions of the individual crystals.

U.S. Pat. No. 2,882,413 discloses a display screen for an X-ray device in which the light intensity is increased by providing V-shaped grooves in a supporting plate, the walls of the grooves being provided with a reflective layer. A luminescent crystalline material is provided in the grooves. The side of the screen on which the luminescent material is provided in the grooves is the side where the image is visible. With such a screen the resolving power is also restricted by the crystal dimensions of the luminescent material and the thermal loadability is small.

U.S. Pat. No. 2,436,182 discloses a phosphorescent screen consisting of a plate of synthetic resin in which dye and phosphorescent material are embedded. Such screens can be loaded only slightly thermally and the resolving power leaves much to be desired.

It is the object of the invention to provide a luminescent screen which has a very high thermal loadability and a large resolving power, in which no diffuse reflections occur, and in which a very large part of the generated light emanates through the substrate.

According to the invention, a luminescent screen of the kind mentioned in the first paragraph is characterized in that the activated layer and the substrate constitute a single self-supporting monocrystalline body, said activated layer being provided with a pattern of V-shaped grooves. Such monocrystalline screens but without grooves are described in the non-prepublished Netherlands Patent Application Ser. No. 7707008 (PHN 8891). These V-shaped grooves preferably satisfy the following relationship $$2.5 < d/h < 4.5 \quad (1),$$

where d is the pitch between two grooves succeeding in one direction and h is the depth of the grooves, since in that case the amount of light falling through the substrate is maximum. The loss of luminescence due to the presence of grooves in the luminescent layer and the increase of light falling through the substrate are optimized in that case. The groove walls reflect the light originally radiated laterally in the layer in the direction of the non-activated part of the single crystal. As result of this a $1\frac{1}{2}$ to $2\frac{1}{2}$ times as large amount of light emanates from the luminescent screen of the invention as compared with such a luminescent screen without grooves. Since the substrate and the luminescent layer moreover constitute one single crystal, there is no crystallographic interface and no granular structure and hence no diffuse reflections can occur. Moreover, as a result of this construction the heat dissipation from the luminescent layer to the substrate is very good and the screen can be loaded thermally to a high extent. The single crystal may be formed from a large number of materials, for example, oxides, silicates, aluminates and gallates of the rare earth metals. The luminescent screen preferably has a thickness which lies between 0.01 and 0.1 times the diameter of the luminescent screen, since in that case it is self-supporting. The luminescent layer preferably has a thickness of from 1 to 6 $\mu$m, in particular r approximately 2 $\mu$m, which corresponds approximately to the depth of penetration of the electrons. The grooves have preferably a depth which is approximately equal to the layer thickness.

It is possible to manufacture a luminescent screen according to the invention by causing a quantity of activator to diffuse in the surface of a single crystal. However, this is a very slow process. It is alternatively possible to vapour-deposit a layer with activator, succeeded by a thermal treatment.

The activated layer is preferably grown by liquid phase epitaxy from a solution (flux) and the pattern of grooves is etched in the layer. This etching may be carried out, for example, by means of reactive sputter etching which is known from semiconductor technology. A luminescent screen according to the invention may be used successfully in a cathode ray tube for displaying a very bright picture. The formation of a very bright picture is necessary in projection television display tubes. In order to obtain a sufficiently bright picture, said tubes so far had to have display screens of comparatively large dimensions. The picture displayed on the screen of a diameter of, for example, 13 cm have to be very bright to generate a sufficient luminous flux for projection. Tubes have been made with screens having a diameter 13 cm with an average surface brightness of approximately 1.5 mW/cm$^2$ sr. A cathode ray tube according to the invention is very suitable for use in a television projection device because the good thermal dissipation enables the generation of the required luminous flux by means of a much smaller screen. It is possible, for example, to manufacture a luminescent screen having an area smaller than 20 cm$^2$, preferably smaller than 5 cm$^2$, in which the average power density of the irradiated light is certainly larger than $2^{mW}$/cm$^2$ sr. in most of the cases, however, larger than $5^{mW}$/cm$^2$ sr.

Embodiments of the invention will now be described in greater detail with reference to the drawing, in which FIG. 1 is a diagrammatic sectional view of a part of a prior art luminescent screen, FIG. 2 is a diagrammatic sectional view of a part of a luminescent screen according to the present invention.

Figure 1:
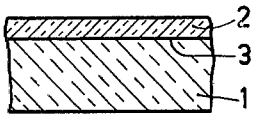

FIG. 1 is a sectional view of a part of a monocrystalline luminescent screen of the prior art. The substrate consists of rock salt (mineral kitchen salt) on which a layer of zinc sulphide has been vapour deposited after heating to approximately 175° C., which layer has been activated at approximately 350° C. with lead or copper and has been annealed at the same temperature. The heat transfer from the layer to the substrate 1 is insufficient for many applications and furthermore diffuse reflections of the generated light occur at the interface 3.

Figure 2:
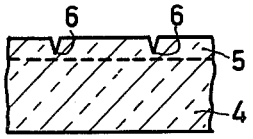

FIG. 2 is a sectional view of a part of a monocrystalline luminescent screen according to the invention. The substrate 4 consists in this case of an yttrium-aluminum garnet ($Y_3A1_5O_{12}$). A cerium-activated layer 5 of yttrium-aluminum-garnet ($Y_{2.97}Ce_{0.03}A1_5O_{12}$) was grown on said substrate by epitaxial growth from the liquid phase (LPE). In this manner a single monocrystalline body is formed which contains a number of cerium atoms in a surface layer. Since no crystallographic interface is present between the activated layer (above the broken line) and the non-activated substrate (below the broken line) diffuse reflections cannot occur either. A pattern of grooves 6 is provided in the activated layer. The grooves constitute squares having sides of approximately 20 μm. The depth of the grooves is approximately 1.5 μm. The luminous efficiency of such a screen with grooves is 1½ times as large as the luminous efficiency of a similar screen without grooves.

A number of properties of the $Y_3A1_5O_{12}$ substrate and the $Y_{2.97}Ce_{0.03}A1_5O_{12}$ layer used in this case are recorded in the following table:

| Substrate: | $Y_3Al_5O_{12}$ |
|---|---|
| structure: | cubic $A_0$ = 12.001 A |
| hardness: | 8–8.5 Moh |
| melting point: | 2220 K |
| thermal conductivity | 0.13 W/cmK |
| expansion: | 7.5 $10^{-6}$ |
| refractive index: | 1.84 |
| activated layer | $Y_{2.97}Ce_{0.03}Al_5O_{12}$ |
| Cathode ray energy efficiency: | 3% (25 lm/W) |
| decay time: | 70 ns |
| wavelength of the maximum emmission | 555 nm |
| extinguishing temperature: | 580 K |
| groove depth: | 1.5 μm |
| pattern: | mutually perpendicular grooves |
| pitch: | 20 μm in both directions |

Figure 3:
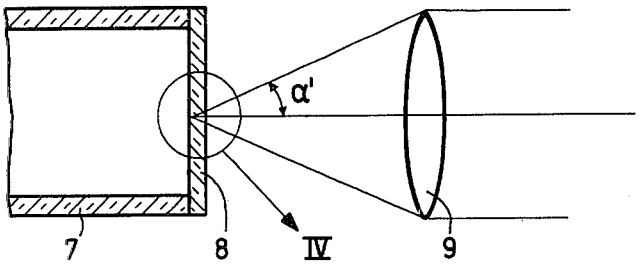
FIG. 3 to 5 are various diagrammatic views showing the operation of the V-shaped grooves, FIG. 6*a, b* and *c* show a number of possible groove patterns.
Figure 4:
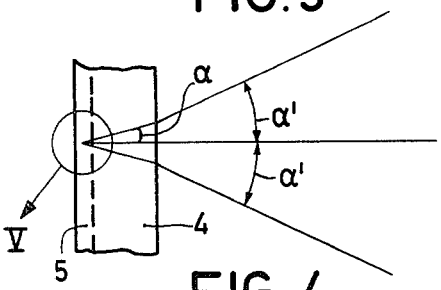
Figure 5:
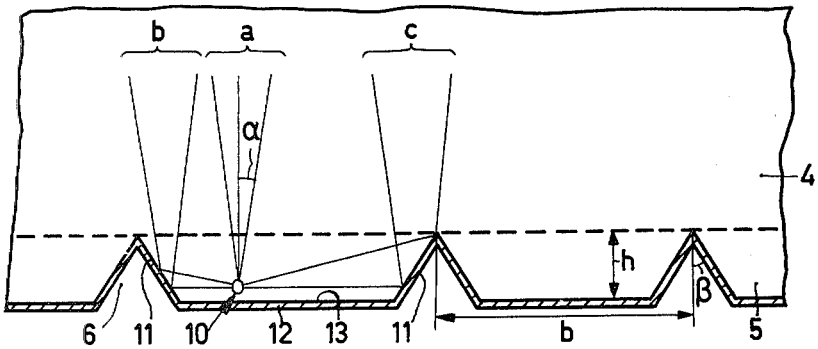

The operation of a pattern of grooves in a luminescent screen will now be described in greater detail with reference to FIGS. 3, 4 and 5. FIG. 3 shows a cathode ray tube 7 having a luminescent screen 8 according to the invention. At some distance from the display screen an optical element is present, in this case a lens 9, which accepts a maximum light cone having half an apex $\alpha'$ of a luminescent particle in the centre of the activated layer of the luminescent screen. For other particles not situated in the centre $\alpha'$ is somewhat smaller. As a result of refraction at the surface of the luminescent screen, as shown in FIG. 4 half the apex in the material with refractive index n of the screen is smaller, namely $\alpha'$, where $\sin \alpha' = n\alpha$. FIG. 5 shows how the amount of light falling through the surface can be increased by providing grooves. Without grooves a luminescent particle 10 would radiate only a light cone a in the direction of the lens. By providing grooves 6 and an aluminum film 12, reflecting groove walls 11 are formed as a result of which the light originally radiated laterally is reflected towards the lens in the form of light cones b and c. Reflection at the surfaces 13 between the grooves also occurs. As a result of this there is also an optimum slope $\beta$ of the groove wall. Not only is the light impinging directly on the groove wall reflected, but also the reflected image reflected at the surface 13. The full reflected image contributes to the luminous efficiency if $$\beta = 45° - \alpha/2,$$

so that in that case the reflection is optimum.

Figure 6:
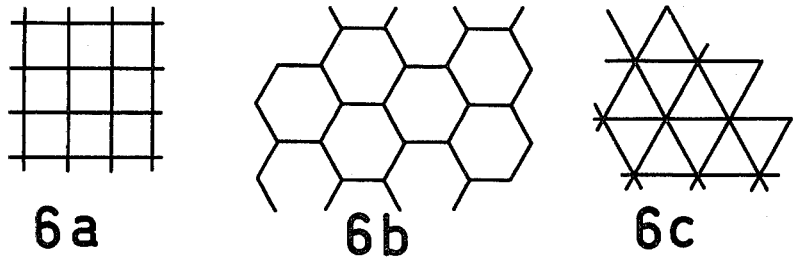

FIG. 6 shows a number of possible groove patterns.

Figure 7:
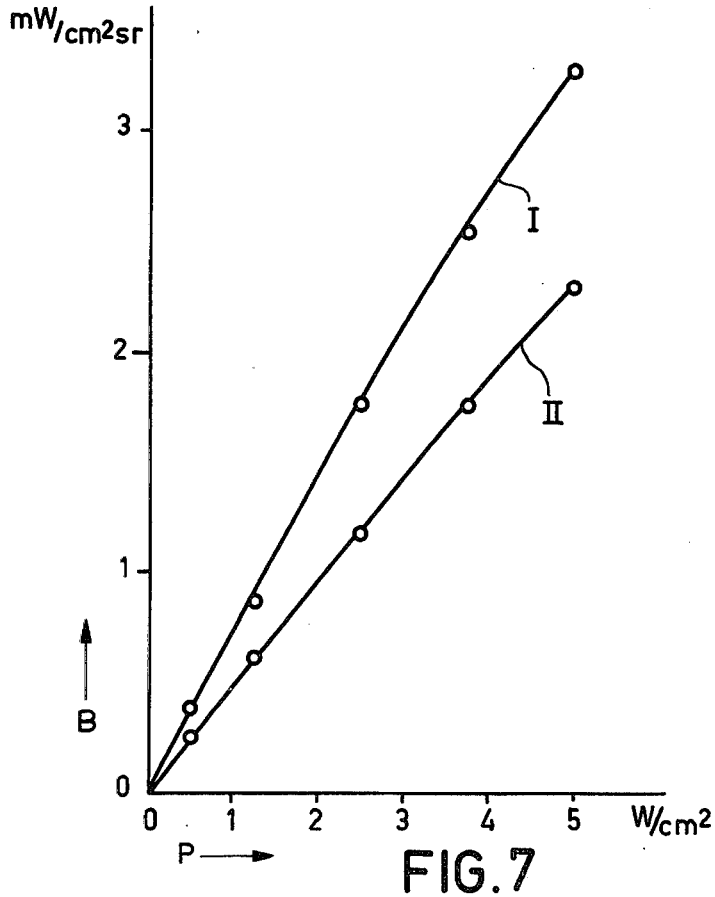
FIG. 7 is a graph showing the large average surface brightness of a luminescent screen according to the invention as compared with a luminescent screen without V-shaped grooves.

FIG. 7 shows with reference to a graph the average surface brightness B as a function of the average energy density P supplied by the electron beam in a tube having a luminescent screen according to the above table (curve I) in comparison with a similar luminescent screen without grooves, (curve.).

In a luminescent screen having a powdered phosphor as used so far, the luminescent material with this supplied power becomes too hot. In addition, the phosphor becomes saturated and no longer radiates light when the supplied power is increased.

It has been found that the construction according to the invention does not become too hot. The luminescent layer does not become too hot as a result of the very good thermal contact of said layer with the substrate with which the luminescent layer forms one single crystal. As a result of the grooves, a larger part of the generated light falls through the substrate.

Figure 8:
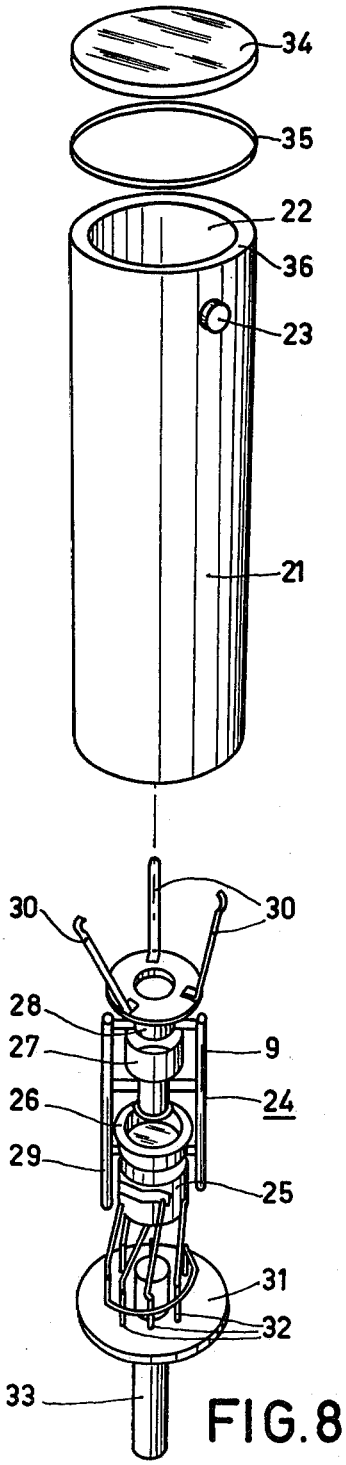
FIG. 8 is a perspective exploded view of a cathode ray tube according to the invention.

FIG. 8 is a perspective exploded view of a cathode ray tube having a luminescent screen according to the invention. An electron gun 24 is accommodated in a cylindrical envelope 21 of aluminum oxide which is provided on the inside with an electrically conductive coating 22 connected to the anode contact 23. Said gun is assembled from a cathode (not visible) which is arranged so as to be insulated in the Wehnelt electrode 25, and a number of grids 26, 27 and 28. The electrodes of the gun are secured together in the usual manner by means of glass assembly rods 29. At one end the gun has centering springs 30. The other end of the gun is connected to base plate 31 which has contact leadthroughs 32 and exhaust tube 33. The other end of the envelope is sealed by the luminescent screen 34 which in this case consists of a gadolinium-gallium garnet and which is activated with europium on its side facing the electron gun. The activated layer has a honeycomb pattern of grooves having a depth of 2 μm and a pitch of 20 μm. The thickness of the luminescent screen is 500 μm and its diameter is 25 mm. The luminescent screen is covered with an aluminum film (not visible here). The luminescent screen 34 is connected to the aluminum oxide envelope 21 by means of a thermocompression bond. For that purpose, an aluminum ring 35 is used as a bonding material between the edge 36 of the envelope and the luminescent screen 34. The coefficient of expansion of the aluminum oxide of the envelope and the coefficient of expansion of the luminescent screen differ only slightly so that no undesired stresses occur as a result of thermal expansion. The deflection of the electron beam generated by the electron gun is obtained in the usual manner by means of magnetic deflection fields. However, it is also possible as such to use electrostatic deflection since in these small display screens only a small deflection is necessary.

Figure 9:
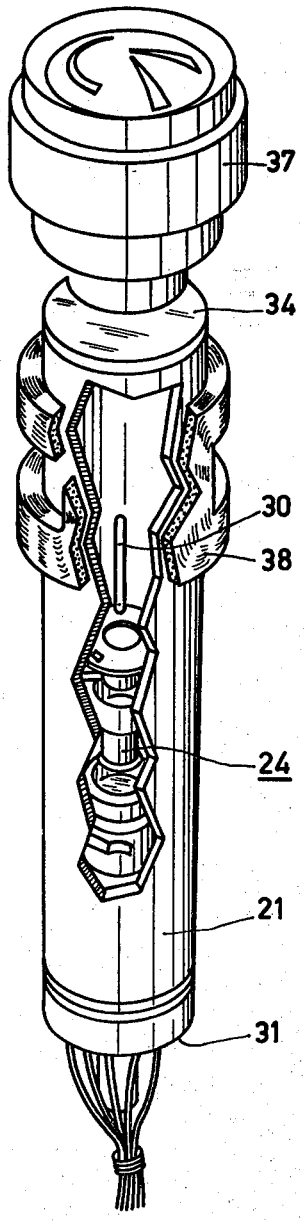
FIG. 9 is a perspective view of an assembled tube as shown in FIG. 8.

FIG. 9 is a perspective view, partly broken away, of the assembled tube of FIG. 8 as a component of a projection television device. Deflection coils 38 are provided around the envelope 21. The very bright image on the luminescent screen 34 is projected onto a projection screen (not shown) by means of a system of lenses 37.

What is claimed is:

1. A luminescent screen comprising a substrate having a luminescent layer of a monocrystalline structure said layer including at least one activator, characterized in that the activated layer and the substrate together constitute a single self-supporting monocrystalline body, the activated layer being provided with a pattern of V-shaped grooves.

2. A luminescent screen as claimed in claim 1, characterized in that $2.5<d/h<4.5$ where d is the pitch between two grooves succeeding each other in one direction and h is the groove depth.

3. A luminescent screen as claimed in claim 1 or claim 2, wherein the screen is circular characterized in that the thickness of the luminescent screen is between 0.01 and 0.1 times the diameter of the luminescent screen.

4. A luminescent screen as claimed in claim 3, characterized in that the luminescent layer has a thickness between 1 and 6 μm.

5. A luminescent screen as claimed in claim 1 or claim 2, characterized in that the luminescent layer has been grown epitaxially from a solution, sometimes termed flux (LPE), and the pattern of grooves is etched in the layer.

6. A cathode ray tube for generating a bright light spot comprising in an evacuated envelope means to generate at least one electron beam and a display screen, characterized in that the display screen is a luminescent screen as claimed in claim 1 or claim 2.

7. A projection television device comprising optical means for displaying a very bright picture on a projection screen, characterized in that the very bright picture is generated by means of a cathode ray tube as claimed in claim 6.

8. A projection television device as claimed in claim 7, characterized in that $$\beta=45^\circ-\alpha/2,$$

where $\beta$ is the slope of the groove wall and corresponds to the angle between the plane in which a groove wall is situated and a line perpendicular to the display screen, $\alpha'$ is half the apex of the light cone accepted by the optical means and originating from the centre of the display screen, and $\alpha$ is half the apex in the material of the luminescent screen prior to refraction, where it holds that $\sin \alpha'=n \sin \alpha$.

* * * * *

UNITED STATES PATENT AND TRADEMARK OFFICE

CERTIFICATE OF CORRECTION

PATENT NO. : 4,298,820

DATED : November 3, 1981

INVENTOR(S) : Piet F. Bongers et al.

It is certified that error appears in the above—identified patent and that said Letters Patent is hereby corrected as shown below:

Column 4, line 32, "nα" should read -- n sinα --.

Signed and Sealed this

Second Day of March 1982

[SEAL]

Attest:

GERALD J. MOSSINGHOFF

Attesting Officer

Commissioner of Patents and Trademarks